US009718123B2

(12) United States Patent
Kikuchi

(10) Patent No.: US 9,718,123 B2
(45) Date of Patent: Aug. 1, 2017

(54) DIE CASTING APPARATUS AND DIE CASTING METHOD

(71) Applicant: TOYOTA JIDOSHA KABUSHIKI KAISHA, Toyota-shi (JP)

(72) Inventor: Makoto Kikuchi, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/915,827

(22) PCT Filed: Jul. 24, 2014

(86) PCT No.: PCT/JP2014/069553
§ 371 (c)(1),
(2) Date: Mar. 1, 2016

(87) PCT Pub. No.: WO2015/033693
PCT Pub. Date: Mar. 12, 2015

(65) Prior Publication Data

US 2016/0193652 A1 Jul. 7, 2016

(30) Foreign Application Priority Data

Sep. 3, 2013 (JP) ..... 2013-182209

(51) Int. Cl.
*B22D 17/20* (2006.01)
*B22D 17/30* (2006.01)
(Continued)

(52) U.S. Cl.
CPC ..... *B22D 17/2046* (2013.01); *B22D 17/145* (2013.01); *B22D 17/2023* (2013.01);
(Continued)

(58) Field of Classification Search
CPC ..... B22D 17/02; B22D 17/04; B22D 17/06; B22D 17/30; B22D 17/32; B22D 39/003
(Continued)

(56) References Cited

U.S. PATENT DOCUMENTS 5,375,646 A * 12/1994 Stummer ..... B22D 17/32 164/113
5,388,633 A * 2/1995 Mercer, II ..... B22D 17/32 164/136
(Continued)

FOREIGN PATENT DOCUMENTS

CN 203156004 U 8/2013
DE 26 34 658 A1 2/1977
(Continued)

OTHER PUBLICATIONS

International Search Report issued Oct. 14, 2014 in PCT/JP2014/069553 (with English language translation).

*Primary Examiner* — Kevin E Yoon
(74) *Attorney, Agent, or Firm* — Oblon, McClelland, Maier & Neustadt, L.L.P.

(57) ABSTRACT

Provided are a die casting method and a die casting apparatus for preventing molten metal from being unexpectedly supplied into a sleeve under decompression. Molten metal supply control for pumping up molten metal with an electromagnetic pump and supplying the molten metal into a sleeve in a state of decompressing a cavity of a die and the inside of the sleeve attached to the die, including: moving the surface of the molten metal, with the electromagnetic pump, from a standard position to the side opposite to a supply direction of the molten metal; decompressing the cavity and the inside of the sleeve; and weakening force of the electromagnetic pump, which pumps down the molten
(Continued)

metal to the side opposite to the supply direction to supply the molten metal into the sleeve.

3 Claims, 4 Drawing Sheets

(51) Int. Cl.
*B22D 17/32* (2006.01)
*B22D 17/14* (2006.01)
*B22D 17/22* (2006.01)

(52) U.S. Cl.
CPC ..... *B22D 17/22* (2013.01); *B22D 17/30* (2013.01); *B22D 17/32* (2013.01)

(58) Field of Classification Search
USPC ..... 164/13, 147.1, 309, 312–318
See application file for complete search history.

(56) References Cited

U.S. PATENT DOCUMENTS

| | | | |
|---|---|---|---|
| 2012/0261086 | A1 | 10/2012 | Kikuchi |
| 2014/0216678 | A1 | 8/2014 | Kikuchi |

FOREIGN PATENT DOCUMENTS

| | | | |
|---|---|---|---|
| JP | 59-178166 | A | 10/1984 |
| JP | 2011-125920 | A | 6/2011 |
| JP | 2013-66896 | A | 4/2013 |
| JP | 2014-117727 | A | 6/2014 |

* cited by examiner

DIE CASTING APPARATUS AND DIE CASTING METHOD

TECHNICAL FIELD

The present invention relates to a die casting method and a die casting apparatus.

BACKGROUND ART

Die casting manufactures a large number of castings with high accuracy of dimensions in a short time by pressing molten metal into a cavity formed in a die. For example, JP 2013-066896 A discloses a die casting apparatus decompressing a cavity and the inside of a sleeve, and pumping up molten metal into the sleeve with an electromagnetic pump.

However, in the die casting apparatus disclosed in JP 2013-066896 A, while the cavity and the inside of the sleeve are decompressed, some of the molten metal pumped up to a standard position of the electromagnetic pump may be supplied into the sleeve by suction force caused by decompression. Note that the standard position of the electromagnetic pump is a surface position of the molten metal in the electromagnetic pump where the electromagnetic pump can pump up the molten metal.

CITATION LIST

Patent Literature

PTL1: JP 2013-066896 A

SUMMARY OF INVENTION

Technical Problem

The object of the present invention is to provide a die casting method and a die casting apparatus for preventing molten metal from being unexpectedly supplied into a sleeve under decompression.

Solution to Problem

Problems to be solved by the invention are as described above, and means for solving these problems are explained below.

A first aspect of the present invention is a die casting method for pumping up molten metal with an electromagnetic pump and supplying the molten metal into a sleeve in a state of decompressing a cavity of a die and the inside of the sleeve attached to the die, including: moving the surface of the molten metal, with the electromagnetic pump, from a standard position to the side opposite to a supply direction of the molten metal; decompressing the cavity and the inside of the sleeve; and weakening force of the electromagnetic pump, which pumps down the molten metal to the side opposite to the supply direction to supply the molten metal into the sleeve.

A second aspect of the present invention is the die casting method further including: preparing a pipe connecting the electromagnetic pump to the sleeve; disposing flow rate detectors detecting the flow of the molten metal on the parts of the pipe at the side of the electromagnetic pump and at the side of the sleeve; and controlling the supply of the molten metal into the sleeve with the electromagnetic pump based on the condition detected by the flow rate detectors.

A third aspect of the present invention is a die casting apparatus including a die, a sleeve attached to the die, a decompressor decompressing a cavity and the inside of the sleeve, and an electromagnetic pump pumping up the molten metal, and supplying the molten metal into the sleeve in a state decompressing the cavity of the die and the inside of the sleeve. The die casting apparatus further includes: a pipe connecting the electromagnetic pump to the sleeve; flow rate detectors detecting the molten metal, which are disposed on the parts of the pipe at the side of the electromagnetic pump and at the side of the sleeve; and a controller controlling the supply of the molten metal into the sleeve with the electromagnetic pump, based on the condition detected by the flow rate detectors.

Advantageous Effects of Invention

In accordance with a die casting method and a die casting apparatus according to the present invention, molten metal is prevented from being unexpectedly supplied into a sleeve under decompression.

DESCRIPTION OF EMBODIMENTS

Figure 1:
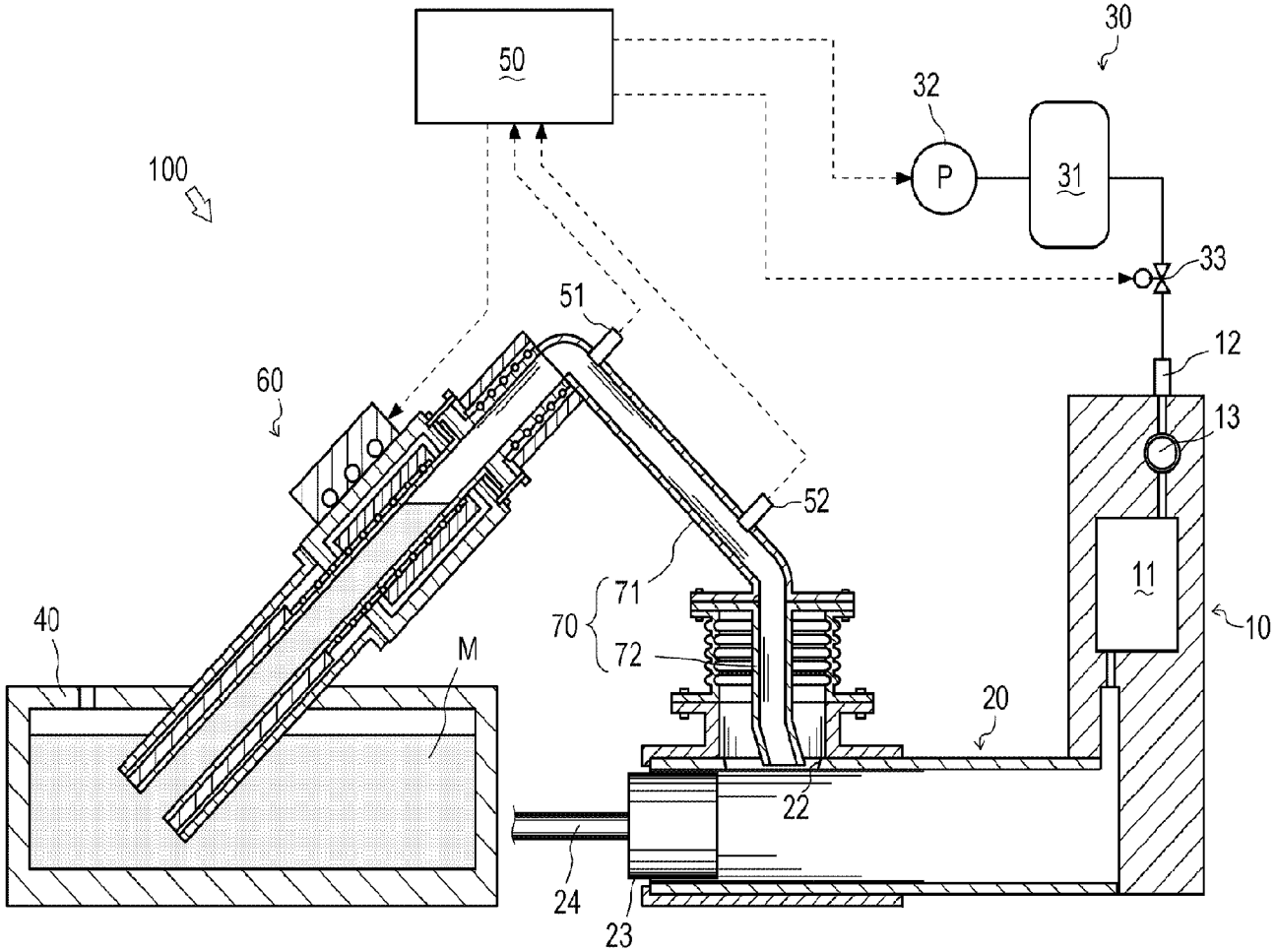
FIG. 1 shows a configuration of a die casting apparatus.

A configuration of a die casting apparatus 100 is explained using FIG. 1.

FIG. 1 shows the die casting apparatus 100 in a side view.

The die casting apparatus 100 is an embodiment of a die casting apparatus according to the present invention. The die casting apparatus 100 decompresses a cavity 11 and the inside of a sleeve 20, and pumps up a proper amount of molten metal M from a molten metal holding furnace 40 into the sleeve 20 with an electromagnetic pump 60.

The die casting apparatus 100 includes a die 10, the sleeve 20, a decompressing device 30, the molten metal holding furnace 40, a controller 50, the electromagnetic pump 60 and a supply pipe 70.

The cavity 11 is formed in the die 10. The die 10 is provided with a suction port 12 and a shut valve 13. The suction port 12 communicates with the cavity 11. Air in the cavity 11 is sucked from the suction port 12. The shut valve 13 is disposed on a route connecting the cavity 11 and the suction port 12.

The sleeve 20 is formed in a substantially cylindrical shape. The sleeve 20 is attached to the die 10 and protrudes from the die 10 to the left side. The inside of the sleeve 20 communicates with the cavity 11. A supply port 22 is formed on the sleeve 20. An injection tip 23 is slidably stored in the sleeve 20. The molten metal M is supplied to the supply port 22 through the supply pipe 70 as mentioned below.

The injection tip 23 is formed in a short cylindrical shape. The injection tip 23 is slidably stored in the sleeve 20. The injection tip 23 pushes out the molten metal M supplied from the supply port 22 into the sleeve 20, and injects the molten metal M into the cavity 11.

The injection tip 23 is disposed on the tip part of a support shaft 24. The support shaft 24 is inserted into the sleeve 20. The support shaft 24 is slidably controlled by, for example, a hydraulic cylinder (not illustrated). The hydraulic cylinder is connected with the controller 50.

The decompressing device 30 (in the present embodiment, a decompressed tank 31 and a vacuum pump 32) is connected with the suction port 12 and communicates with the cavity 11. Specifically, the decompressed tank 31 is connected with the vacuum pump 32, and the vacuum pump 32 can decompress the inside of the decompressed tank 31. The decompressed tank 31 is connected with the suction port 12. Thus, the inside of the decompressed tank 31 can communicate with the cavity 11.

An on-off valve 33 is disposed on a connection route connecting the decompressed tank 31 to the suction port 12 so as to open and close the connection route. The vacuum pump 32 and the on-off valve 33 are connected to the controller 50. The controller 50 performs the open and close control of the on-off valve 33 and the operation control of the vacuum pump 32.

The molten metal holding furnace 40 stores the molten metal M therein. The molten metal holding furnace 40 stores the molten metal M with the molten metal M insulated from the atmosphere.

One end of the electromagnetic pump 60 is inserted into the molten metal M in the molten metal holding furnace 40 at an angle of approximately 45 degrees, and the electromagnetic pump 60 pumps up the molten metal M from the molten metal holding furnace 40. The inner peripheral part of the electromagnetic pump 60 is formed of ceramic. The electromagnetic pump 60 pumps up or pumps down (pumps in the direction opposite to pump-up force) the molten metal M by electromagnetic force caused by applying voltage to a coil, linked with injection control, built in the electromagnetic pump 60. The electromagnetic pump 60 is connected to the controller 50.

In the supply pipe 70, the top end as one end thereof is connected to the electromagnetic pump 60 and the bottom end as the other end thereof is disposed at the position facing the supply port 22. The supply pipe 70 is configured by connecting an upper supply pipe 71 and a lower supply pipe 72.

The top part of the upper supply pipe 71 is connected to the top part (the other part) of the electromagnetic pump 60, and the upper supply pipe 71 is disposed to incline downward toward the sleeve 20. The top part of the lower supply pipe 72 is connected to the bottom part of the upper supply pipe 71. The lower supply pipe 72 extends from the upside of the supply port 22 into the supply port 22.

The controller 50 is connected to the vacuum pump 32, the on-off valve 33, a first flow rate detection sensor 51, a second flow rate detection sensor 52 and the electromagnetic pump 60. The controller 50 has functions of decompressing the cavity 11 and the inside of the sleeve 20, and of supplying to a proper amount of the molten metal M into the sleeve 20 with the electromagnetic pump 60.

The first flow rate detection sensor 51 and the second flow rate detection sensor 52 detect flow of the molten metal M passing through the supply pipe 70, and act as flow rate detectors according to the present invention. The first flow rate detection sensor 51 and the second flow rate detection sensor 52 are laser level sensors for detecting, by receiving laser beam oscillated toward the supply pipe 70, whether the molten metal M passes through the supply pipe 70 or not.

The first flow rate detection sensor 51 is disposed on the top part (the end part at the side of the electromagnetic pump 60) of the upper supply pipe 71. The second flow rate detection sensor 52 is disposed on the bottom part (the end part at the side of the supply port 22) of the upper supply pipe 71.

Figure 2:
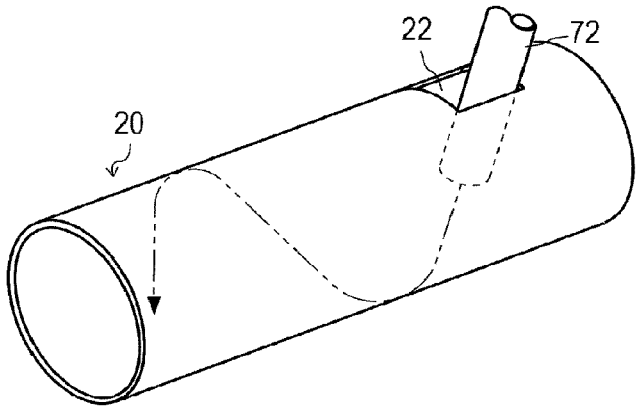
FIG. 2 shows configurations of a supply pipe and a sleeve.

Configurations of the supply pipe 70 and the sleeve 20 is explained using FIG. 2.

FIG. 2 schematically shows the configurations of the supply pipe 70 and the sleeve 20 perspectively.

The supply pipe 70 (the lower supply pipe 72) is inserted into the supply port 22 of the sleeve 20. The lower supply pipe 72 is disposed on the inside of the sleeve 20 such that the bottom end of the lower supply pipe 72 comes in contact with one side part of the inner peripheral surface of the sleeve 20 and that the axis of the lower supply pipe 72 and the axis of the sleeve 20 cross diagonally.

By this configuration, the molten metal M supplied from the lower supply pipe 72 into the sleeve 20 is stored in the sleeve 20 after flowing spirally in the sleeve 20 (see the arrow shown by the two-dot chain line in FIG. 2).

Figure 3:
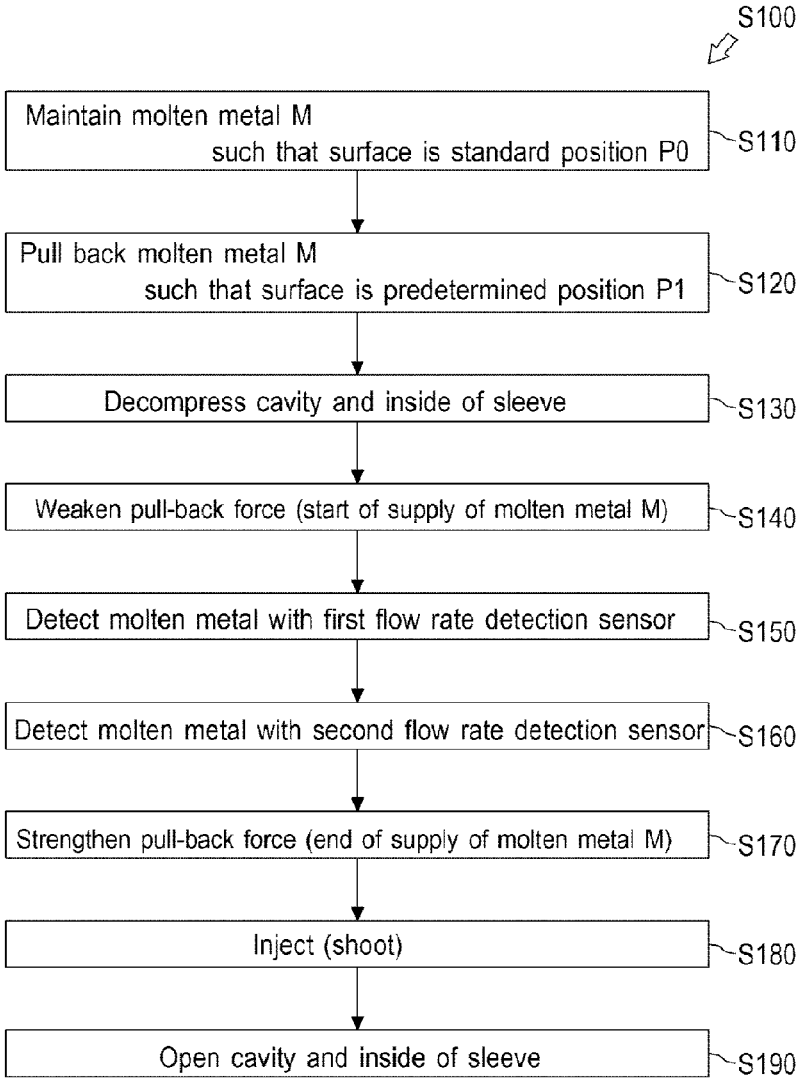
FIG. 3 shows flow of molten metal supply control.

Flow of molten metal supply control S100 is explained using in FIG. 3.

The molten metal supply control S100 is an embodiment of a die casting method according to the present invention. In the molten metal supply control S100, the cavity 11 and the inside of the sleeve 20 are decompressed by decompressing the cavity 11 and the inside of the sleeve 20, and the electromagnetic pump 60 pumps up the proper amount of the molten metal M to supply the molten metal M into the sleeve 20.

In the molten metal supply control S100, steps S110 to S190 are performed in order.

In the step S110, the controller 50 controls the electromagnetic pump 60, and the molten metal M from the molten metal holding furnace 40 is maintained by the pump-up force of the electromagnetic pump 60 such that a surface position of the molten metal M is at a standard position P0 in the electromagnetic pump 60. Note that the standard position P0 is the surface position of the molten metal in the electromagnetic pump 60 where the electromagnetic pump 60 can pump up the molten metal M.

In the step S120, the controller 50 controls the electromagnetic pump 60, and the molten metal M in the electromagnetic pump 60 is pumped down by pump-down force of the electromagnetic pump 60 (the force in the direction opposite to the pump-up force in the electromagnetic pump 60) such that the surface of the molten metal at the standard position P0 is a predetermined position P1 (the position lower than the standard position P0, that is to say, the position in the side opposite to the supply direction of the molten metal M).

In the step S130, the controller 50 activates the vacuum pump 32 and opens the on-off valve 33 to decompress the cavity 11, and the inside of the sleeve 20 and the supply pipe 70.

In the step S140, when the pressure in the sleeve 20 and the supply pipe 70 reaches a predetermined degree of the decompression, the controller 50 gradually weakens the pump-down force of the electromagnetic pump 60. Thereby, the molten metal M in the electromagnetic pump 60 is pumped up and supplied into the sleeve 20 by the suction force caused by the decompression of the inside of the sleeve 20 and the supply pipe 70 (the start of the supply of the molten metal M).

In the step S150, the controller 50 detects the molten metal M within the top end part of the upper supply pipe 71 with the first flow rate detection sensor 51. The controller 50 determines that the molten metal M is pumped up by the electromagnetic pump 60 and flows into the supply pipe 70 by detecting the molten metal M within the top end part of the upper supply pipe 71 with the first flow rate detection sensor 51.

In the step S160, the controller 50 detects the molten metal M within the bottom end part of the upper supply pipe 71 with the second flow rate detection sensor 52.

The controller 50 determines that abnormal conditions such as clogging of the upper supply pipe 71 do not occur by detecting the molten metal M within the bottom end part of the upper supply pipe 71 with the second flow rate detection sensor 52.

The controller 50 calculates difference (a transit time S1 of the molten metal M from the top end to the bottom end of the upper supply pipe 71) between time when the second flow rate detection sensor 52 detects the molten metal M within the bottom end part of the upper supply pipe 71 and time when the first flow rate detection sensor 51 detects the molten metal M within the top end part of the upper supply pipe 71, when the second flow rate detection sensor 52 detects the molten metal M within the bottom end part of the upper supply pipe 71.

If the transit time S1 is longer than normal transit time S (the transit time, preset in the controller 50, of the molten metal M from the top end part to the bottom end part of the upper supply pipe 71 in normal condition), some of the molten metal M remains in the upper supply pipe 71 after the molten metal M passes through the upper supply pipe 71 (some of the molten metal M is congealed in the upper supply pipe 71), so that the molten metal M may not smoothly flow in the upper supply pipe 71.

Relation between difference between the transit time S1 and the transit time S, and the amount of the molten metal M remaining in the upper supply pipe 71 (the amount of the remaining molten metal) is previously calculated, and the relation is preset in the controller 50. The amount of the remaining molten metal is obtained from the difference between the transit time S1 and the transit time S by the controller 50 using the relation. In the next molten metal supply control S100, the amount of the molten metal is supplied which is determined by subtracting the amount of the remaining molten metal from the proper supply amount of the molten metal set previously.

In this way, the flow condition of the molten metal M (the amount of the remaining molten metal) in the upper supply pipe 71 is detected based on the difference between the transit time S and the transit time S1 detected by the first flow rate detection sensor 51 and the second flow rate detection sensor 52, and the supply of the molten metal M into the sleeve 20 with the electromagnetic pump 60 is controlled based on the detected flow condition of the molten metal M (the amount of the remaining molten metal). The remaining molten metal in the upper supply pipe 71 is melted by the molten metal M to be supplied into the upper supply pipe 71 in the next molten metal supply control S100.

In the step S170, after predetermined time T1 passes from the step S140, controller 50 gradually strengthens the pump-down force of the electromagnetic pump 60. Thereby, the molten metal M is pumped down to the side of the electromagnetic pump 60, and the supply of the molten metal M is finished (the end of the supply). The predetermined time T1 is time when the proper amount of the molten metal M passes through the supply pipe 70, and is preset in the controller 50.

In the step S180, the controller 50 controls the hydraulic cylinder so that the hydraulic cylinder pushes out the support shaft 24 toward the die 10, so that the injection tip 23 slides in the sleeve 20 and the molten metal M is injected toward the cavity 11.

In the step S190, the die 10 is opened, and a work molded in the cavity 11 is taken out. The pressure of the cavity 11, and the inside of the sleeve 20 and the supply pipe 70 come to the atmospheric pressure.

Figure 4:
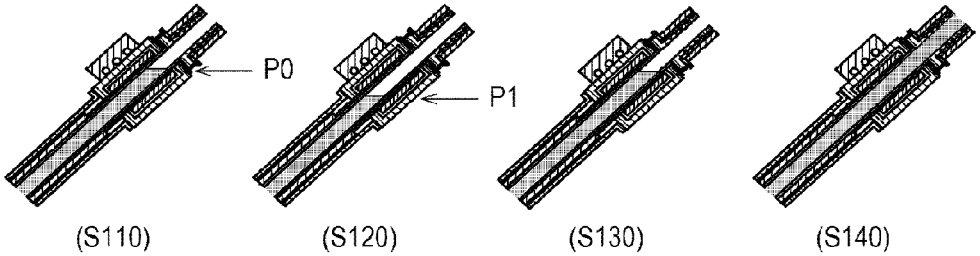
FIG. 4 shows action of the molten metal supply control.
Figure 4:
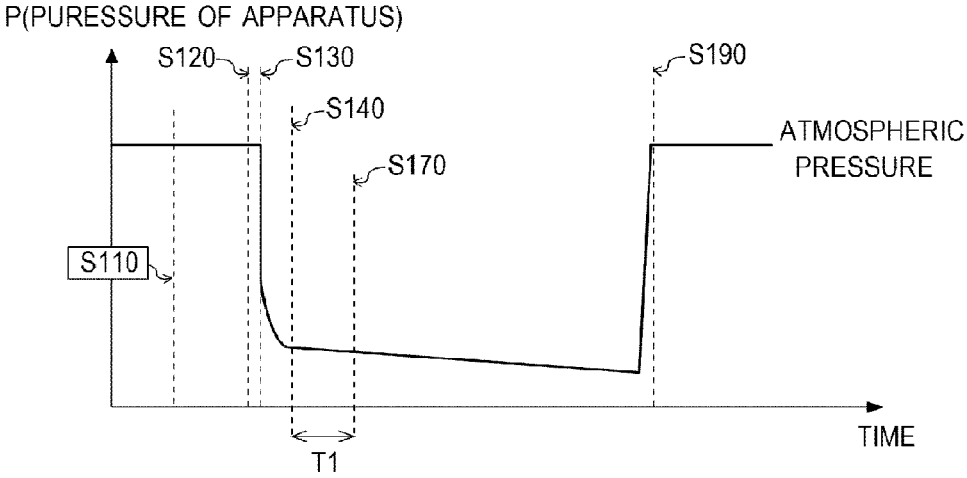

Action of the molten metal supply control S100 is explained using FIG. 4.

FIG. 4 shows the action of the molten metal supply control S100 using a schematic view showing the surface of the molten metal M in the electromagnetic pump 60 and a graph showing time-series changes of the pressure in the die casting apparatus 100 (in the sleeve 20 and the supply pipe 70).

In the step S110, the molten metal M in the molten metal holding furnace 40 is pumped up by the pump-up force of the electromagnetic pump 60 such that the surface of the molten metal M is at the standard position P0 in the electromagnetic pump 60.

In the step S120, the molten metal M in the electromagnetic pump 60 is pumped down by the pump-down force of the electromagnetic pump 60 such that the surface of the molten metal M at the standard position P0 reaches the predetermined position P1 (the position lower than the standard position P0).

In the step S130, the cavity 11, and the inside of the sleeve 20 and the supply pipe 70 are decompressed by activating the vacuum pump 32 and opening the on-off valve 33. At this time, the surface position of the molten metal M in the electromagnetic pump 60 goes down to the predetermined position P1, so that the molten metal M does not flow into the supply pipe 70 by the suction force caused by the decompression.

In the step S140, the pump-down force of the electromagnetic pump 60 is gradually weakened, and the molten metal M in the electromagnetic pump 60 is pumped up into the sleeve 20 by the suction force caused by the decompression (the start of the supply of the molten metal M).

In the step S170, the pump-down force of the electromagnetic pump 60 is gradually strengthened, and the molten metal M is pumped down. Then, the supply of the molten metal M is finished (the end of the supply of the molten metal M).

In the step S190, the die 10 is opened, and the work molded in the cavity 11 is taken out. The pressure of the cavity 11, and the inside of the sleeve 20 and the supply pipe 70 come to the atmospheric pressure.

Effects of the die casting apparatus 100 and the molten metal supply control S100 are explained.

In accordance with the die casting apparatus 100 and the molten metal supply control S100, the molten metal M is prevented from being unexpectedly supplied into the sleeve 20 under the decompression. Before the decompression, the surface position of the molten metal M in the electromagnetic pump 60 goes down to the predetermined position P1, so that the molten metal M does not flow into the supply pipe 70 by the suction force caused by the decompression.

In accordance with the die casting apparatus 100 and the molten metal supply control S100, occurrence of abnormal conditions in the upper supply pipe 71 is detected by the first flow rate detection sensor 51 and the second flow rate detection sensor 52. The next supply amount of molten metal is increased or decreased based on the detected flow condition of the molten metal M (the amount of the remaining molten metal) by detecting the flow condition of the molten metal M (the amount of the remaining molten metal) in the upper supply pipe 71, so that the proper amount of the molten metal is supplied into the sleeve 20.

In accordance with the die casting apparatus 100, by the molten metal M flowing spirally from the lower supply pipe 72 into the sleeve 20, the temperature change of the inside of the sleeve 20 is suppressed, so that the initial solidified piece of the molten metal M can be made small and deformation of the inside of the sleeve 70 can be minimized.

In the present embodiment, the first flow rate detection sensor 51 and the second flow rate detection sensor 52 are laser level sensors, but the present invention is not limited thereto. For example, the first flow rate detection sensor 51 and the second flow rate detection sensor 52 may be magnetic field sensors.

INDUSTRIAL APPLICABILITY

The present invention is applicable to a die casting method and a die casting apparatus pumping up molten metal with an electromagnetic pump.

REFERENCE SIGNS LIST

10: die
11: cavity
20: sleeve
22: supply port
30: decompressing device
50: controller
51: first flow rate detection sensor
52: second flow rate detection sensor
60: electromagnetic pump
70: supply pipe
71: upper supply pipe
72: lower supply pipe

The invention claimed is:

1. A die casting method for pumping up molten metal with an electromagnetic pump and supplying the molten metal into a sleeve in a state of decompressing a cavity of a die and the inside of the sleeve attached to the die, comprising:

moving the surface of the molten metal, with the electromagnetic pump, from a standard position to the side opposite to a supply direction of the molten metal;

decompressing the cavity and the inside of the sleeve; preparing a pipe connecting the electromagnetic pump to the sleeve; disposing flow rate detectors detecting a flow of the molten metal on the parts of the pipe at a side of the electromagnetic pump and at a side of the sleeve; and weakening force of the electromagnetic pump, which pumps pumping down the molten metal to the side opposite to the supply direction to supply the molten metal into the sleeve.

2. The die casting method according to claim 1, further comprising:

controlling the supply of the molten metal into the sleeve with the electromagnetic pump based on the condition detected by the flow rate detectors.

3. A die casting apparatus including a die, a sleeve attached to the die, a decompressor decompressing a cavity and the inside of the sleeve, and an electromagnetic pump pumping up the molten metal, and supplying the molten metal into the sleeve in a state decompressing the cavity of the die and the inside of the sleeve, comprising:

a pipe connecting the electromagnetic pump to the sleeve;

flow rate detectors detecting the molten metal, which are disposed on the parts of the pipe at a side of the electromagnetic pump and at a side of the sleeve; and a controller controlling the supply of the molten metal into the sleeve with the electromagnetic pump, based on the condition detected by the flow rate detectors.

* * * * *